United States Patent [19]

Suzuki

[11] 4,122,826

[45] Oct. 31, 1978

[54] SUBMERSIBLE BODY WARMER APPARATUS

[76] Inventor: Katumi Suzuki, 15-1 Oozone-cho, Higashi-ku, Nagoya-shi, Aichi-ken, Japan

[21] Appl. No.: 753,730

[22] Filed: Dec. 23, 1976

[30] Foreign Application Priority Data

Dec. 25, 1975 [JP] Japan ..... 50/155556

[51] Int. Cl.[2] ..... A61F 7/06

[52] U.S. Cl. ..... 126/208; 128/142 R; 128/142.5; 431/328

[58] Field of Search ..... 126/204, 208, 360 R; 431/328; 128/142 R, 142.5

[56] References Cited

U.S. PATENT DOCUMENTS

| | | | |
|---|---|---|---|
| 3,107,728 | 10/1963 | Kehn | 431/328 |
| 3,513,824 | 5/1970 | Fitzgerald et al. | 126/204 |
| 3,556,205 | 1/1971 | Harwood et al. | 126/204 |
| 3,898,978 | 8/1975 | Marcus | 126/204 |
| 3,922,136 | 11/1975 | Koch | 431/328 |

*Primary Examiner*—Ronald C. Capossela
*Attorney, Agent, or Firm*—Carroll F. Palmer

[57] ABSTRACT

A submersible body warmer apparatus adapted to use on a diver's body and comprising a heat radiating casing body in which a self-contained fuel is combusted with air or oxygen from a source from within or without the casing body. The casing body includes a passage through which air thereby heated passes to an exhaust opening while heat is radiated from the casing body to warm a diver's body.

4 Claims, 8 Drawing Figures

SUBMERSIBLE BODY WARMER APPARATUS

BACKGROUND OF THE INVENTION

This invention relates to a submersible body warmer apparatus for a diver, or to a warmer apparatus for warming the body of a diver under water.

A water to which a diver is exposed usually has a substantially lower temperature than the diver's body temperature so that the diver's body is cooled and chilled, and this not only makes the diver uncomfortable, but more important, inhibits the diver to continue his operation under water beyond the time when his body temperature is reduced to a certain degree.

Wet suits for divers have been known which might be useful to prevent direct exposure of the diver's body to the chilling water. Such wet suits have been usually not water-tight and an amount of water enters or is present in spacing area between a wet suit and a wearer's body under water. Even if so, of course, the retained water is to be warmed gradually in a certain period of time by the wearer's body temperature to provide under the wet suit a warming atmosphere which a wet suit should against the outside water of a lower temperature. However, particularly when the surrounding outside water has a lower temperature than the diver's body temperature by a substantial degree, such a warming atmosphere can not be established until a substantial length of time elapses. And, more fatally, a chilling water may more often than not newly enter from the outside under the wet suit so as to destroy the warming atmosphere. The diver's body is then rapidly chilled so that a period of time allowed for his submersive operation can not be prolonged beyond a restricted length of time.

SUMMARY OF THE INVENTION

Accordingly one of the objects of the invention is to provide a submersible warmer apparatus for warming the body of a diver under water thereby to allow the diver to make his operation under water for a prolonged period of time without a chilling influence by the surrounding outside water.

Another object of the invention is to provide a submersible warmer apparatus capable of warming comfortably the whole body of a wet suit wearing diver under water.

Still another object of the invention is to provide a submersible body warmer apparatus thereby to function to prevent the surrounding outside water from entering under a wet suit or between a wet suit and the diver's body so that heat insulation by the wet suit may be enhanced.

Other objects, advantages and features of the invention will be fully understood in the following description made about preferred embodiments of the invention with reference to the accompanying drawings.

DESCRIPTION OF THE PREFERRED EMBODIMENTS

Figure 5:
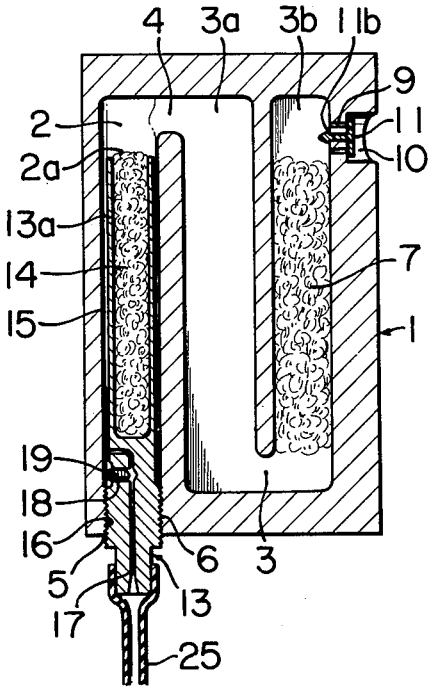
FIG. 5 is a sectional view taken along line V—V of FIG. 2.
Figure 4:
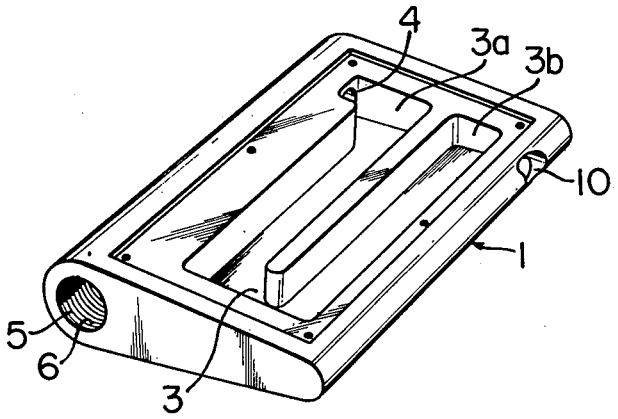
FIG. 4 is a perspective view of a body of the heat radiating casing of the embodiment.

Referring to FIGS. 4 and 5, a submersible body warmer apparatus has a heat radiating casing body 1 made of a lightweight, heat-conductible material, e.g., aluminum or the like, and having a generally flat form as shown in FIG. 4. The body 1 is hollowed in one lateral side portion to form therein a combustion chamber 2 extending in the longitudinal direction thereof, and is grooved on a contiguous surface to the combustion chamber 2 to form a U-shaped heated air passage 3 having an upstream and downstream sections 3*a* and 3*b*. The combustion chamber 2 has therein a combustion region 2*a* communicated through a ventilating aperture 4 with the upstream section 3*a* of heated air passage 3, and an opening 5 is formed in a position of casing body apart from the combustion region 2*a* to open the interior of chamber 2 to without casing body 1. The opening 5 has a thread 6 formed in the inner circumferential wall for the purpose hereinafter described.

Figure 2:
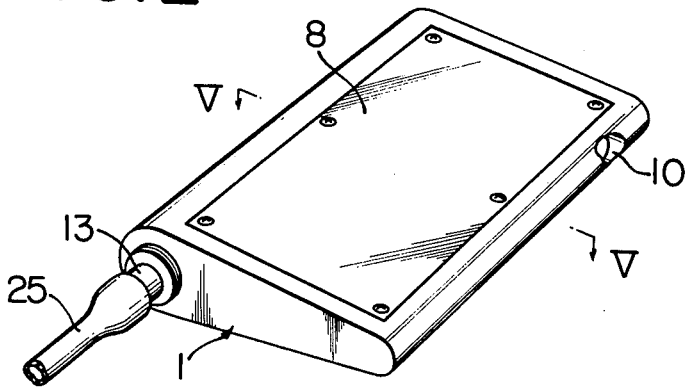
FIG. 2 is a perspective view of a heat radiating casing of the embodiment.
Figure 3:
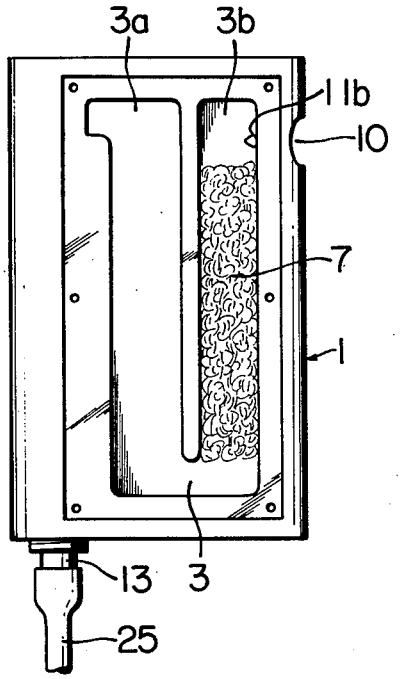
FIG. 3 is a front view of the heat radiating casing of the embodiment having a closure plate taken away.
Figure 6:
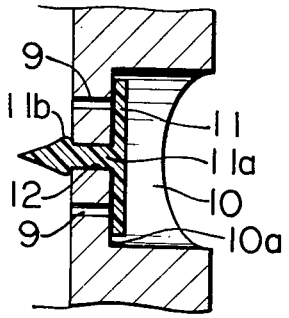
FIG. 6 is an enlarged sectional view showing an exhaust opening of the heat radiating casing body of the embodiment.

Heated air passage 3 has an amount of air-previous water absorbant material 7, e.g., wad or the like, housed in the downstream section 3*b* to substantially fill the cross-section of the downstream section 3*b*. As suggested in the foregoing, the heated air passage 3 is open at the top surface of casing body as shown in FIG. 3 and a closure plate 8 is water-tightly, but detachably mounted on the opened top surface of casing body as shown in FIG. 2 to close or functionally complete the heated air passage 3. Thus, material 7 may be replaced by a new one. A recess 10 is formed in a lateral outer side portion of casing body 1 which is opposed to combustion chamber 2 adjacent to a downstream extremity of the downstream section 3*b* and has a bottom surface 10*a*, as most clearly shown in FIG. 6, in which a suitable number of exhaust apertures 9,9 are opened at one end and extends through the side wall of casing body to open at another in the interior of downstream section of heated air passage 3. The recess 10 further includes a valve mount bore 12 formed in the side wall of casing body in a spaced position from the exhaust apertures 9,9, and a closure member 11 of suitably elastic material covering openings of the exhaust apertures 9,9 on the inner side surface and having a stem 11*a* extending through the valve mount bore 12 to terminate in the interior of the downstream section 3*b* of heated air passage 3. The stem 11*a* has a circumferential protrusion 11*b* to rigidly engage the stem in the bore 12. Thus, the elastic closure member 11 is adapted to act like a check valve relative to the exhaust apertures 9,9. Namely, when a water pressure is exerted on the outer side surface to a more degree than an inner pressure on the inner side surface of closure member 11, the latter is forced in contact with the bottom surface 10*a* of recess 10 including openings of the exhaust apertures 9,9 to tightly close the latter, and when an inner pressure on the inner side surface comes to overcome a water pressure on the outer side surface of closure member 11, the latter is deformed away from the bottom surface 10*a* of recess 10 to open the exhaust apertures to without the casing body.

In the combustion chamber 2, there is provided a closed bottom, generally hollow cylindrical fuel reservoir member 13 having a solid bottom end section around whose outer circumference is threaded at 16 to engage the aforementioned thread 6 of opening 5 of the combustion chamber 2, whereby the fuel reservoir member 13 or precisely a major cylindrical section thereof is held in the chamber 2. The major cylindrical section has an inner open end 13*a*, and a fuel absorbing fibrous material 14 or, e.g. a fibrous wad with a volatile oil soaked therein, is housed in the cylindrical section and exposed in the open end 13*a* to the region 2*a* of combustion chamber 2. The cylindrical section of the fuel reservoir member 13 has a smaller outer diameter than an inner diameter of the combustion chamber 2, enough to define therebetween an annular spacing 15 for an air passage. The solid bottom section of fuel reservoir member 13 has an air supply passage 17 formed therein to open at an inner end into the annular spacing 15 and at an outer end into the body casing. The air supply passage 17 is provided adjacent the inner end with a threaded aperture 18 formed in the solid section of fuel reservoir member 13 to threadedly receive a screw member 19 for movement into and out of air supply passage 17 in its diametrical direction, which screw thus reduces and increases an effective sectional area of the air supply passage 17 thereby to function to establish an adjusted amount of air supply into the combustion chamber 2. An air filter, although not shown, may be provided in the air supply passage at a suitable location or typically adjacent the outer end.

Figure 1:
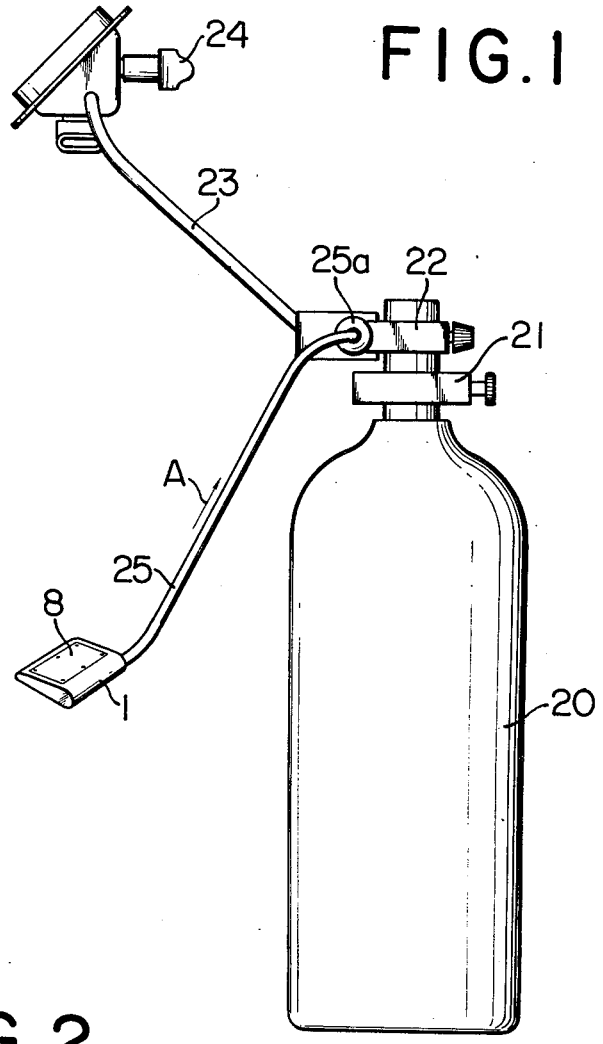
FIG. 1 is a perspective view showing one particular embodiment of the invention connected in Aqualung equipment.

The outer end portion of the solid bottom section of fuel reservoir member 13 in which open is the outer end of air supply passage 17 is coupled with one end of an air supply hose 25 (FIGS. 2, 3 and 5) which, as shown in FIG. 1, has the other end connected through a check valve 25*a* with a primary pressure reduction device 22 mounted on a pressurized air cylinder 20. The pressurized air cylinder 20 is adapted to be carried on the back of a diver and has valve means 21 interposed between the interior of cylinder and the primary pressure reduction device 22. The check valve 25*a* acts to prevent supply air flow in a reversed direction or a direction designated by Arrow A of FIG. 1. A mouthpiece device 24 adapted to be held in the mouth of a diver is connected through an air hose 23 also with the primary pressure reduction device 22 whereby initially pressurized air held in the cylinder 20 may be reduced in pressure and supplied to the mouthpiece device 24 and partially to the air supply passage 17.

In use, fuel absorbed in material 14 may be ignited at open end 2*a* of reservoir 13 dislodged from combustion chamber 2 and the reservoir 13 is inserted through opening 5 into combustion chamber 2 and thread 16 is then screwed on thread 6 of opening 5. The submersible body warmer above is worn by a diver carrying the pressure cylinder 20 on his back, preferably under a wet suit in contact directly with his body skin. While a major portion of air released from pressure cylinder 20 and pressure reduced in primary pressure reduction device 22 is supplied to mouthpiece 24 for inhalation of a diver, a minor portion of the air is fed via supply hose 25 into air supply passage 17 in which it is adjusted to a suited flow rate dependent on opening degree of screw member 18. An adjusted flow rate of the air is then supplied along annular spacing 15 into combustion region 2*a* of chamber 2 wherein it is used for combustion of fuel from reservoir 14. In other words, fuel or a volatile oil stored in reservoir 13 is kept to be combusted in region 2*a* of chamber 2 adjacent inner open end 13*a* of reservoir 13 with air continuously fed therein, when fuel soaked, fibrous material 14 in reservoir acts like a wick. Air heated by combustion is allowed to enter upstream section 3*a* of air passage 3 through ventilating aperture 4 and flow toward the downstream extremity of downdtream section 3*b*, while heat exchange is made with casing body 1 and closure plate 8 which in turn exchanges heat with the body of diver to warm the latter so that the diver's body is prevented from being substantially chilled, even when a diver is operating in water of a fairly lower temperature than the body temperature, thereby to permit his submersive operation to be prolonged.

The air is finally allowed to be exhausted outside the warmer apparatus via exhaust apertures 9,9 and closure member 11, causing the latter to be deformed into the open position. The exhaust gas released from heat radiating casing body 1 comes to fill the spacing area between the diver's body and the wet suit, so that heat remaining in the released gas is conducted through a water present therebetween thereby to warm not only one location of his body but also his whole body enclosed in the wet suit.

If any water enters under a wet suit further enters the interior of heated air passage 3 while closure member 11 is thus opened, the water is prevented from reaching combustion region 2*a* because it can be absorbed in fibrous material 7 positioned in downstream portion 3*b* and because U-shaped air passage 3 forms a curved path which the water must flow before reaching the region 2*a*.

The exhaust gas is further released from under the wet suit through openings thereof, such as neck and cuffs, into the surrounding water, so that ingress of the surrounding water through these openings tends to be prevented. This permits the warming atmosphere to be maintained within the wet suit permanently or at least for a substantially long period of time.

To replenish reservoir 13 with fuel, fuel is poured through open end 13*a* into the reservoir 13 disloged from combustion chamber 2 to be absorbed in material 14 therein.

Figure 7:
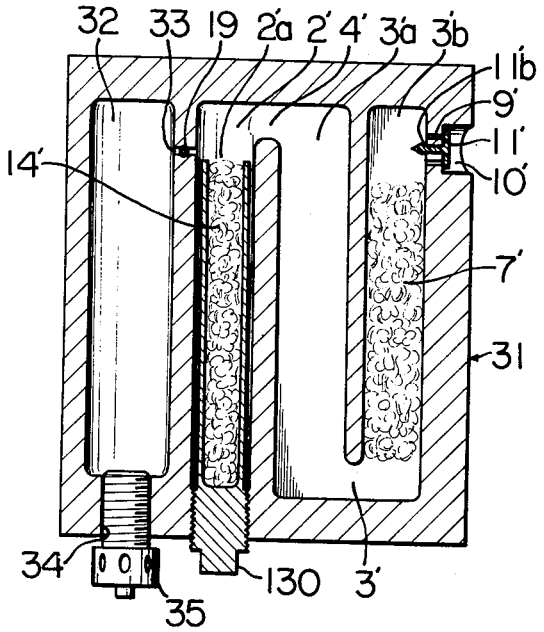
FIG. 7 is a similar view to FIG. 5 but showing a first modification of the invention.

FIG. 7 shows a first modification of the invention in which an air source for combustion is not constituted by a pressurized air cylinder to be carried by a diver on the back, but instead by a compressed air chamber provided in a heat radiating casing body per se. The self-contained, submersible body warmer apparatus specifically includes a compressed air chamber 32 formed in a contiguous position of a combustion chamber 2', and an air supply passage 33 formed in a patition wall of casing body 31 between compressed air chamber 32 and combustion region 2'*a* of chamber 2' to communicate the two with each other. The air supply passage 33 is provided with a screw member 19 to function, like the screw member 18 of the above described embodiment, to therein adjust a supply rate of air into combustion region 2'*a* of chamber 2'. The compressed air chamber 32 has an air refilling opening 34 formed in an outer wall of casing body 31 to open the chamber interior to without casing body, and in the opening 34 provided is known valve means 35 through which an air from an outer pressurized source may be charged to refill the hermetically sealed air chamber 32. All the other elements and portions are identical to those of the above described embodiment, and may be omitted from the further description, with similar reference numerals to those of FIGS. 1 to 6 designating the corresponding elements and portions of the modification in FIG. 7. But, a fuel reservoir member 130 thereof, naturally, does not have any air supply passage in the solid end section.

It is thus understood that the sumersible body warmer apparatus according to the modification is easy for wearing by a diver and facilitates his operation under water, because of an air source being self-contained as the compressed air chamber in the heat radiating casing body 31.

Figure 8:
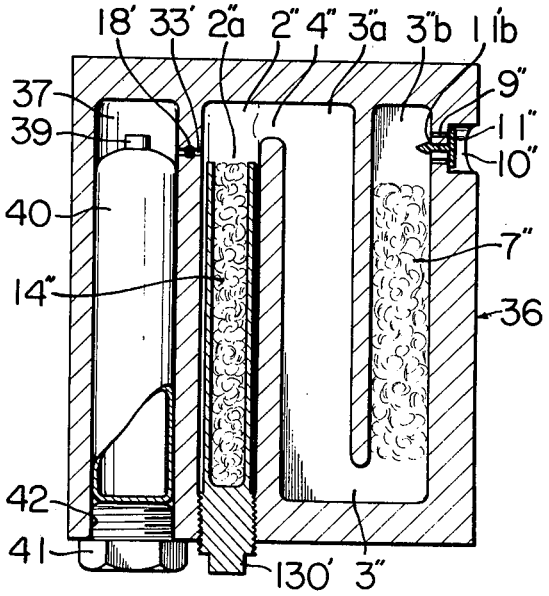
FIG. 8 is a similar view to FIG. 5 but showing a second modification of the invention.

A second modification is illustrated, according to which another self-contained submersible body warmer apparatus is provided, and a commercially available, disposable oxygen cylinder is housed in a heat radiating casing body to constitute an air source. Referring to FIG. 8 showing such a submersible body warmer apparatus according to the second modification, a chamber 37 is formed in a contiguous position of a combustion chamber 2'' and has the interior of a suited dimension adapted to snugly accomodating a commercially available oxygen cylinder 40 provided with a bleeding outlet 39 which includes pressure reduction valve. The accommodating chamber 37 has an opening 42 through which the cylinder 40 is lodged in and replaced from the chamber 37. A plug 41 is mounted in the opening 42 to water tightly close the latter. Similarly, all the other elements and portions are identical to those of the above mentioned first modification, and may be omitted from the further description, with similar reference numerals to those of FIG. 7 designating the corresponding elements and portions of the second modification in FIG. 8.

The submersible body warmer apparatus according to the second modification has not only the advantages above stated about the first modification, but also the further advantages that refilling an air source for combustion can be facilitatingly and rapidly made because an air source is held in a separate cylinder and replaced as a unit, and that a combusting efficiency is enhanced because oxygen gas, instead of air, is supplied for combustion.

The invention should not be constued as resticted to the described preferred embodiments and any further modifications and variations can be conceived by a persons skilled in the art, without deviating the scope and spirit of the invention.

What is claimed is:

1. A submersible body warmer apparatus for an underwater diver wearing a wet suit which comprises a primary pressure reduction device for attachment to a cylinder containing pressurized air carried by a diver, a mouthpiece to be held in the mouth of a diver for inhalation connected to said reduction device for flow of air from said device to said mouthpiece.

a heat radiating casing body of flattened configuration adapted to be held under a diver's wet suit, an exhaust opening in said casing body to communicate the interior thereof with the outside and the space defined between a diver's wet suit and his body, an air supply inlet into said casing body, a sinuous fluid passage way communicating said inlet with said exhaust opening, fuel containing means positioned in said passageway, a combustion chamber in said passageway between said means and said exhaust opening, an air-pervious, water absorbent member in said passageway between said combustion chamber and said exhaust opening, check valve means disposed in said exhaust opening to close and open said opening when water pressure is exerted on said valve means and when inner air pressure in said passageway serves to overcome said water pressure, respectively, and air supply means connecting said inlet to said reduction device.

2. The submersible body warmer of claim 1 wherein said fuel containing means comprises a thimble enclosing a mass of absorbent material containing liquid fuel.

3. The submersible body warmer of claim 2 wherein said thimble is positioned axially in said passageway adjacent said air supply inlet with the open end of said thimble being downstream of said inlet, said thimble being smaller in diameter than said passageway providing space within the passageway for air flow from said inlet around the outside of said thimble past said thimble open end and into said combustion chamber.

4. A submersible body warmer apparatus comprising a heat radiating casing body of a flattened configuration adapted to be held under a diver's wet suit and arranged to retain a fuel and to define a combustion chamber for combusting said fuel and a heated air passage communicated with said combustion chamber and having an air-pervious water absorbent material placed therein, an exhaust opening also defined in said heat radiating casing body to communicate said heated air passage with the outside of said heat radiating casing body for supplying heated air into the space defined between the diver's wet suit and his body, check valve means disposed in said exhaust opening to close and open the latter when a water pressure is exerted on said means and when an inner air pressure in said heated air passage comes to overcome said water pressure, respectively, and a compressed air chamber disposed in said heat radiating casing body to supply air to said combustion chamber.

* * * * *